US009196965B2

(12) United States Patent
Sabielny

(10) Patent No.: US 9,196,965 B2
(45) Date of Patent: Nov. 24, 2015

(54) STACKED MICROSTRIP ANTENNA

(75) Inventor: Michael Sabielny, Ulm (DE)

(73) Assignee: EADS Deutschland GmbH, Ottobrunn (DE)

( * ) Notice: Subject to any disclaimer, the term of this patent is extended or adjusted under 35 U.S.C. 154(b) by 595 days.

(21) Appl. No.: 13/577,147

(22) PCT Filed: Nov. 26, 2010

(86) PCT No.: PCT/DE2010/001377
§ 371 (c)(1),
(2), (4) Date: Sep. 10, 2012

(87) PCT Pub. No.: WO2011/095144
PCT Pub. Date: Aug. 11, 2011

(65) Prior Publication Data

US 2013/0002491 A1 Jan. 3, 2013

(30) Foreign Application Priority Data

Feb. 4, 2010 (DE) ..... 10 2010 006 809

(51) Int. Cl.
*H01Q 9/04* (2006.01)
*H01Q 21/06* (2006.01)

(52) U.S. Cl.
CPC ..... *H01Q 9/0414* (2013.01); *H01Q 21/065* (2013.01)

(58) Field of Classification Search
CPC ..... H01Q 13/08; H01Q 13/10; H01Q 13/24; H01Q 13/28; H01Q 9/04; H01Q 9/0407; H01Q 9/0414; H01Q 21/065
See application file for complete search history.

(56) References Cited

U.S. PATENT DOCUMENTS

| | | | | |
|---|---|---|---|---|
| 4,011,246 | A * | 3/1977 | Markezich | 549/243 |
| 4,477,813 | A * | 10/1984 | Weiss | 343/700 MS |
| 5,363,067 | A | 11/1994 | Crandall et al. | |
| 6,333,719 | B1 | 12/2001 | Varadan et al. | |
| 7,050,004 | B2 | 5/2006 | Shafai et al. | |
| 7,636,063 | B2 | 12/2009 | Channabasappa | |
| 2004/0189527 | A1 | 9/2004 | Killen et al. | |

FOREIGN PATENT DOCUMENTS

| | | | |
|---|---|---|---|
| EP | 1 793 451 | A1 | 6/2007 |
| GB | 2 412 246 | A | 9/2005 |
| JP | 2-252304 | A | 10/1990 |
| JP | 9-98016 | A | 4/1997 |
| JP | 2009-531978 | A | 9/2009 |
| WO | WO 2007/126897 | A2 | 11/2007 |
| WO | WO 2007/149046 | A1 | 12/2007 |

OTHER PUBLICATIONS

German Examination Report dated Aug. 27, 2012 (four (4) pages).
Japanese Office Action (English translation only) dated Feb. 21, 2014 (Two (2) pages).

(Continued)

*Primary Examiner* — Robert Kasacsony
*Assistant Examiner* — Patrick Holecek
(74) *Attorney, Agent, or Firm* — Crowell & Moring LLP

(57) ABSTRACT

A stacked microstrip antenna includes two microstrip antenna elements arranged one above the other, and a dielectric separator between the two microstrip antenna elements. The dielectric separator has one or more cavities.

4 Claims, 1 Drawing Sheet

(56) References Cited

OTHER PUBLICATIONS

International Search Report with English translation dated Apr. 11, 2011 (six (6) sheets).
Waterhouse, R.B. , "Microstrip Patch Antennas :A Designer's Guide", Kluwer Academic Publishers, 2003 (two (2) sheets).
Zivanovic et al., "The Effect of Alignment Tolerance of Multilayer Air Cavity Microstrip Patches", IEEE Antennas and Propagation Society International Symposium, Jun. 9-15, 2007, pp. 381-384 (four (4) sheets).
Lager et al., "Experimental Investigation of the Mutual Coupling Reduction by Means of Cavity Enclosure of Patch Antennas", First European Conference on Antennas and Propagation, Nov. 1-5 and 6-10, 2006 (five (5) sheets).

* cited by examiner

STACKED MICROSTRIP ANTENNA

BACKGROUND AND SUMMARY OF THE INVENTION

Exemplary embodiments of the present invention relate to a stacked microstrip antenna.

The technical literature (e.g. R. B. Waterhouse, Ed., "Microstrip Patch Antennas—A Designers Guide", Kluwer Acad. Publishers, 2003, p. 90), discloses that in order to obtain a wide impedance bandwidth the electromagnetic coupling of the two microstrip antenna elements (also designated hereinafter as patch elements for short) of the antenna that lie one above the other should only be permitted to be weak. The technical consequence is that RF foam materials are used as separator and carrier between the two patch elements, since foams of this type have a low relative permittivity $\in_r$. Such a solution with RF foam materials is known from U.S. Pat. No. 7,636,063 B2. However, these foams are too temperature- and pressure-sensitive for standard PCB processes, which results in complicated and costly production methods.

U.S. Pat. No. 7,636,063 B2 also describes a further approach, in which the interspace between the two patch elements is completely formed by a cavity. The resulting necessary outer carrier for one of the two patch elements is embodied as a housing or radome. This likewise leads to complex and costly production methods.

ZIVANOVIC, B.; WELLER, T. M.; MELAIS, S.; MEYER, T.; "The Effect of Alignment Tolerance on Multilayer Air Cavity Microstrip Patches", IEEE Antennas and Propagation Society International Symposium, 381-384, Jun. 9-15, 2007, doi: 10.1109/APS.2007.4395510; describes a microstrip antenna composed of an individual microstrip antenna element above a ground surface, wherein the intervening dielectric separator has a cavity.

LAGER, I. E.; SIMEONI, M.: "Experimental Investigation of the Mutual Coupling Reduction by Means of Cavity Enclosure of Patch Antennas", First European Conference on Antennas and Propagation, Nov. 1-5, 6-10 2006, doi: 10.1109/EUCAP.2006.4584577; describes a technique for decoupling individual microstrip antennas of an RF group antenna that are arranged alongside one another on an RF printed circuit board. In this case, the individual microstrip antennas are each surrounded by plated-through holes.

U.S. Pat. No. 7,050,004 B2 describes a microstrip antenna whose ground surface is formed by a movable membrane, the position of which relative to the microstrip antenna element can be altered by applying a voltage.

U.S. Pat. No. 5,363,067 A describes a microstrip line comprising two conductors lying alongside each other above a ground surface. The space above the two conductors is formed by a respective cavity within a dielectric substrate.

Exemplary embodiments of the present invention provide a stacked microstrip antenna that is advantageous in terms of production engineering, without the necessary weak electromagnetic coupling of the patch elements being lost.

According to the invention, a separator is arranged between the two patch elements lying one above the other and air cavities are introduced into the separator, e.g., by drilling or milling.

As a result, it is possible to use a separator material that is advantageous in terms of production engineering, even if its relative permittivity $\in_r$ is not optimum (i.e., relatively high) with regard to the desired weak coupling between the patch elements. The necessary matching is effected by the cavities introduced into the separator, which significantly reduces the effective relative permittivity between the patch elements.

This results in a significant reduction of the electromagnetic coupling of the patch elements.

The separator according to the invention thus reduces to a type of holding frame for the structure of the antenna, while the air cavities significantly decrease the effective relative permittivity between the patch elements.

Particularly advantageously, a conventional RF printed circuit board base material (e.g., RO 4003® C from the Rogers Corporation, Microwave Materials Division, 100 S. Roosevelt Avenue, Chandler Ariz. 85226-3415, USA) can be used as separator. Such materials usually consist of a resin with glass fiber inserts introduced therein. They have a good stability and are unproblematic in terms of production engineering. The comparatively high relative permittivity of these materials in relation to an RF foam material is compensated for by the introduced cavity or plurality of cavities.

The following advantages, in particular, are achieved by means of the invention:

- an increase in the bandwidth of the antenna is made possible by the low effective relative permittivity.
- it is possible to use standard RF materials and standard PCB processes for antenna production, such that cost-effective production methods are made possible.
- the availability of robust and broadband antennas is made possible.
- independence from complex antenna solutions, based on RF foams, that are technically difficult to produce.
- diverse application of this technology e.g., as emitter elements for 3D-T/R modules or as circularly polarized, structure-integrated antennas.
- useable in principle for a wide frequency range.

BRIEF DESCRIPTION OF THE DRAWING FIGURES

The invention is explained in greater detail with reference to figures, in which.

DETAILED DESCRIPTION

Figure 1:
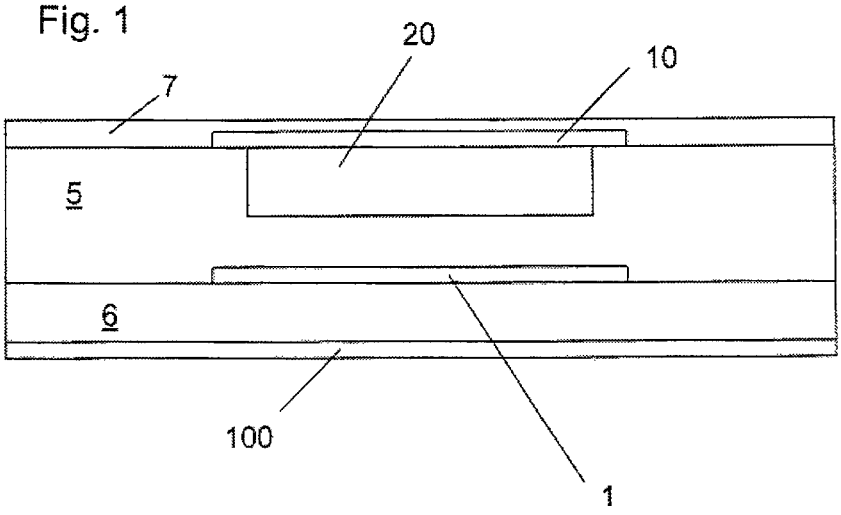
FIG. 1 shows a first embodiment of the antenna according to the invention.
Figure 2:
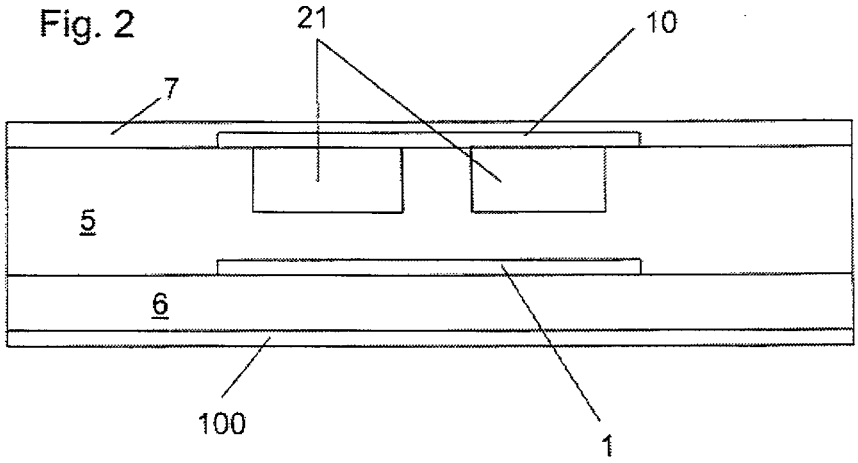
FIG. 2 shows a second embodiment of the antenna according to the invention.

FIGS. 1 and 2 each show an embodiment of the stacked microstrip antenna according to the invention comprising two microstrip antenna elements 1 and 10 arranged one above the other and the ground surface 100. The conductive parts 1, 10, 100 are respectively isolated from one another by dielectric layers 5, 6, 7. The latter consist of conventional RF printed circuit board base material and naturally have a high relative permittivity $\in_r$. The lower patch element 1 is the fed patch element of the antenna, while the upper patch element 10 is the parasitic patch element. As usual in antennas of this type, the parasitic patch element 10 oscillates with the signal emitted by the fed patch element 1 and thus improves the impedance bandwidth of the overall arrangement.

According to the invention, a separator 5 is present between the two stacked patch elements 1, 10, which separator simultaneously serves as a carrier for the upper patch element 10. An air-filled, parallelepipedal or cylindrical cavity 20 is milled into the material of the separator 5, the cavity being situated directly below the parasitic patch element 10 in the embodiment shown. This air cavity 20 significantly reduces the effective relative permittivity between the two patch elements 1, 10, which leads to the desired increased impedance bandwidth of the antenna.

In this embodiment the dielectric layer 6 between lower patch element 1 and ground surface 100 is embodied in continuous fashion (solid material), that is to say has, in particular, no cavities. Consequently, there is a relatively high relative permittivity between these two conductors, which is likewise beneficial for achieving an increased antenna bandwidth.

FIG. 2 shows a variant with respect to the embodiment shown in FIG. 1. Instead of only one cavity, two separate cavities 21 are present there in the separator 5 below the parasitic patch element 10. These two cavities 21 were produced here by drilling in the material of the separator 5.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A stacked microstrip antenna, comprising:

ground surface;

a dielectric layer adjoining a top side of the ground surface;

a lower patch element adjoining a top side of the dielectric layer;

a dielectric separator layer arranged above the lower patch element;

an upper patch element adjoining a top side of the dielectric separator layer, wherein the dielectric separator layer has only one or two air cavities between the lower and upper patch elements, wherein a lateral dimension of the one air cavity or a combined lateral dimension of the two air cavities is less than a lateral dimension of both the upper and lower patch elements, wherein the lower patch element adjoins an underside of the dielectric separator layer, and wherein the dielectric layer between the ground surface and the lower patch element consists of a solid material without cavities.

2. The stacked microstrip antenna as claimed in claim 1, wherein the dielectric separator layer consists of an RF printed circuit board based material.

3. The stacked microstrip antenna as claimed in claim 1, wherein the dielectric separator layer has only one air cavity.

4. The stacked microstrip antenna as claimed in claim 1, wherein the dielectric separator layer has only two air cavities, wherein the two air cavities are laterally spaced-apart.

* * * * *